US008834106B2

(12) United States Patent
Luczak

(10) Patent No.: US 8,834,106 B2
(45) Date of Patent: Sep. 16, 2014

(54) SEAL ASSEMBLY FOR GAS TURBINE ENGINE

(75) Inventor: Blake J. Luczak, Pittsburgh, PA (US)

(73) Assignee: United Technologies Corporation, Hartford, CT (US)

( * ) Notice: Subject to any disclaimer, the term of this patent is extended or adjusted under 35 U.S.C. 154(b) by 597 days.

(21) Appl. No.: 13/150,717

(22) Filed: Jun. 1, 2011

(65) Prior Publication Data

US 2012/0308367 A1 Dec. 6, 2012

(51) Int. Cl.
*F01D 11/12* (2006.01)

(52) U.S. Cl.
CPC ..... *F01D 11/12* (2013.01); *F05D 2300/6033* (2013.01)
USPC ..... 415/173.3; 415/174.2

(58) Field of Classification Search
USPC ..... 415/173.3, 174.3, 173.1, 174.1, 231; 277/350, 307
See application file for complete search history.

(56) References Cited

U.S. PATENT DOCUMENTS

| | | | | |
|---|---|---|---|---|
| 3,798,401 | A * | 3/1974 | Kochanski et al. | 200/84 C |
| 4,087,199 | A | 5/1978 | Hemsworth et al. | |
| 5,304,031 | A | 4/1994 | Bose | |
| 5,609,469 | A * | 3/1997 | Worley et al. | 415/173.1 |
| 6,418,727 | B1 * | 7/2002 | Rice et al. | 60/799 |
| 6,733,233 | B2 | 5/2004 | Jasklowski et al. | |
| 6,736,401 | B2 * | 5/2004 | Chung et al. | 277/355 |
| 6,811,154 | B2 * | 11/2004 | Proctor et al. | 277/355 |
| 7,334,980 | B2 * | 2/2008 | Trinks et al. | 415/1 |
| 7,753,643 | B2 | 7/2010 | Gonzalez et al. | |
| 7,824,152 | B2 | 11/2010 | Morrison | |
| 7,905,495 | B2 | 3/2011 | Munson | |
| 2003/0202876 | A1 | 10/2003 | Jasklowski et al. | |
| 2008/0106046 | A1 * | 5/2008 | Datta et al. | 277/644 |
| 2009/0142180 | A1 * | 6/2009 | Munson | 415/111 |
| 2009/0208322 | A1 * | 8/2009 | McCaffrey | 415/113 |
| 2010/0172754 | A1 | 7/2010 | Flangan | |

FOREIGN PATENT DOCUMENTS

FR 2580033 A1 10/1986

OTHER PUBLICATIONS

Extended European Search Report for Application No. EP 12 16 8441 dated Aug. 2, 2012.

* cited by examiner

*Primary Examiner* — Edward Look
*Assistant Examiner* — Michael Sehn
(74) *Attorney, Agent, or Firm* — Carlson, Gaskey & Olds

(57) ABSTRACT

A seal assembly for a gas turbine engine includes a seal body and a biasing support member. The seal body includes a generally annular shape that defines an outer diameter surface. The biasing support member is circumferentially disposed about the outer diameter surface of the ceramic matrix composite seal body and includes an array of spring fingers that circumferentially overlap about the biasing support member. The array of spring fingers contacts the seal body and centers the seal body relative to the centerline axis of the gas turbine engine.

14 Claims, 6 Drawing Sheets

SEAL ASSEMBLY FOR GAS TURBINE ENGINE

This invention was made with government support under Contract No. W911W6-08-2-0001 awarded by the United States Army. The Government has certain rights in this invention.

BACKGROUND

This application relates to a seal assembly for a gas turbine engine.

Gas turbine engines are known, and they typically include a compressor section delivering compressed air into a combustor section. The compressed air is mixed with fuel and combusted in the combustor section. Products of this combustion are delivered downstream to a turbine section to drive the turbine rotors and the compressor section.

The various sections of the gas turbine engine may include rotating airfoils or blades that are formed of complex airfoil designs and that capture the energy from the products of combustion and translate that energy into rotation. To maximize the efficiency of the gas turbine engine, seal assemblies, such as blade outer air seal (BOAS) assemblies, are positioned proximate to a radial outer portion (tip) of the rotating blades to minimize air flow leakage. Lower clearances between the blades and the seal assemblies improve the operation efficiency of the gas turbine engine. Seals assemblies of this type are exposed to relatively high temperatures during gas turbine engine operation.

SUMMARY

A seal assembly for a gas turbine engine includes a seal body and a biasing support member. The seal body includes a generally annular shape that defines an outer diameter surface. The biasing support member is circumferentially disposed about the outer diameter surface of the seal body and includes an array of spring fingers that circumferentially overlap about the biasing support member. The array of spring fingers contacts the seal body and centers the seal body relative to the centerline axis of the gas turbine engine.

In another exemplary embodiment, a gas turbine engine includes a compressor section, a combustor section and a turbine section each disposed about an engine centerline axis. At least one of the compressor section and the turbine section includes a plurality of rotatable blades. A seal assembly is positioned radially outwardly from each of the plurality of rotatable blades. The seal assembly includes a seal body and a biasing support member positioned radially outwardly from the seal body. The seal body includes a first axial length and the biasing support member includes a second axial length that is greater than the first axial length.

In another exemplary embodiment, a method of providing a seal assembly for a gas turbine engine includes providing a biasing support member having an array of spring fingers that circumferentially overlap about an inner diameter surface of the biasing support member. The biasing support member is positioned about an outer diameter surface of a seal body. The array of spring fingers of the biasing support member contact the seal body to center the seal body relative to a centerline axis of the gas turbine engine.

The various features and advantages of this disclosure will become apparent to those skilled in the art from the following detailed description. The drawings that accompany the detailed description can be briefly described as follows.

DETAILED DESCRIPTION

Figure 1:
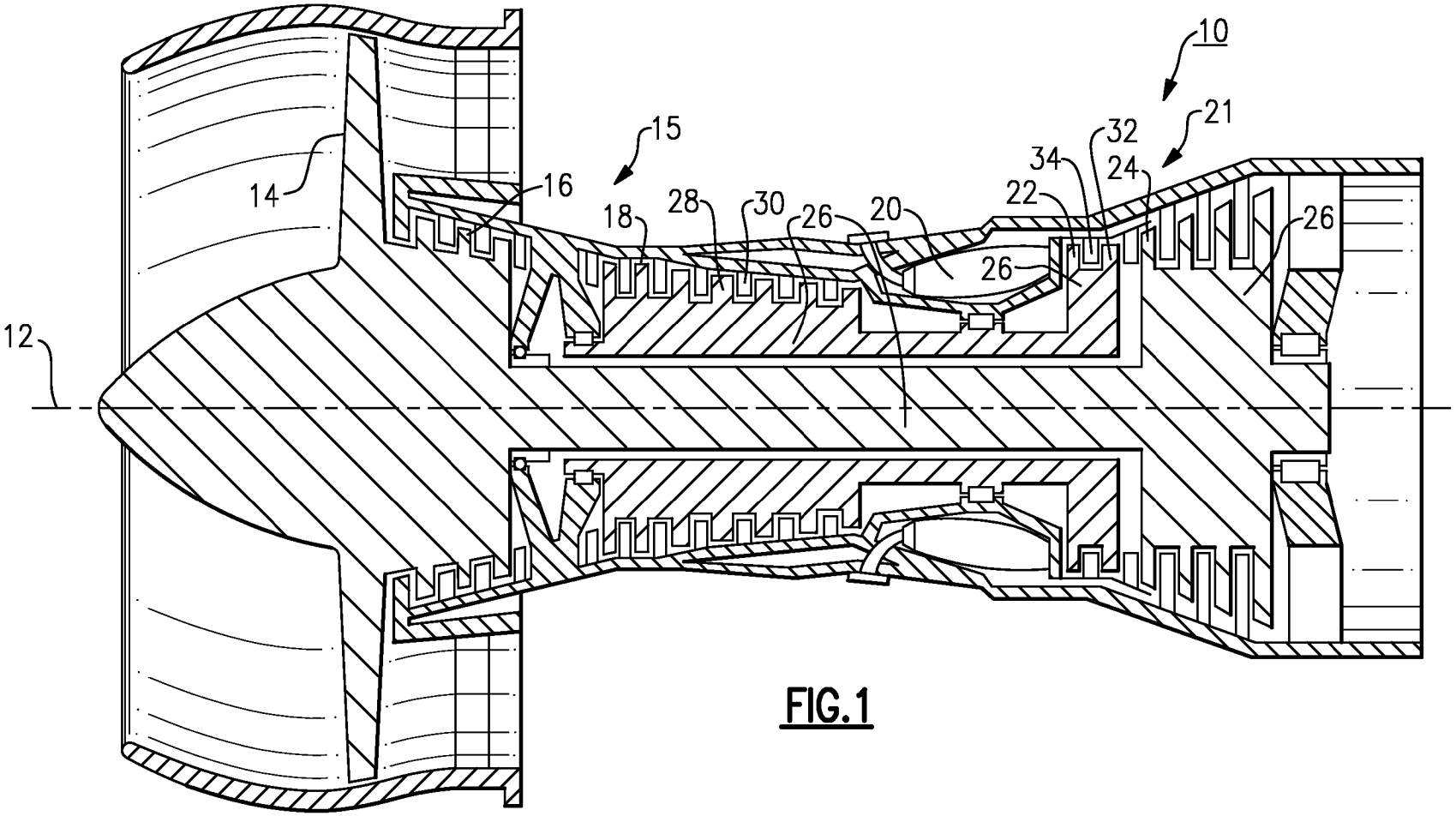
FIG. 1 shows a schematic view of a gas turbine engine.

FIG. 1 shows a gas turbine engine 10, such as a turbofan gas turbine engine, that is circumferentially disposed about a centerline axis (or axial engine centerline axis) 12. The gas turbine engine 10 includes a fan section 14, a compressor section 15 having a low pressure compressor 16 and a high pressure compressor 18, a combustor section 20 and a turbine section 21 including a high pressure turbine 22 and a low pressure turbine 24. This disclosure can also extend to engines without a fan and engines with more or fewer sections.

As is known, air is compressed in the low pressure compressor 16 and the high pressure compressor 18 and is mixed with fuel and burned in the combustor section 20. The air and fuel mixture is then expanded in the high pressure turbine 22 and the low pressure turbine 24. Rotor assemblies 26 rotate in response to the expansion, driving the low pressure and high pressure compressor 16, 18 and the fan section 14. The low and high pressure compressors 16, 18 include alternating rows of rotating compressor rotor airfoils or blades 28 and static stator vanes 30. Similarly, the high and low pressure turbines 22, 24 include alternating rows of rotating turbine rotor airfoils or blades 32 and static stator vanes 34.

This view is highly schematic and is included to provide a basic understanding of the sections of a gas turbine engine 10 and not to limit the disclosure. This disclosure extends to all types of gas turbine engines and for all types of applications.

Figure 2:
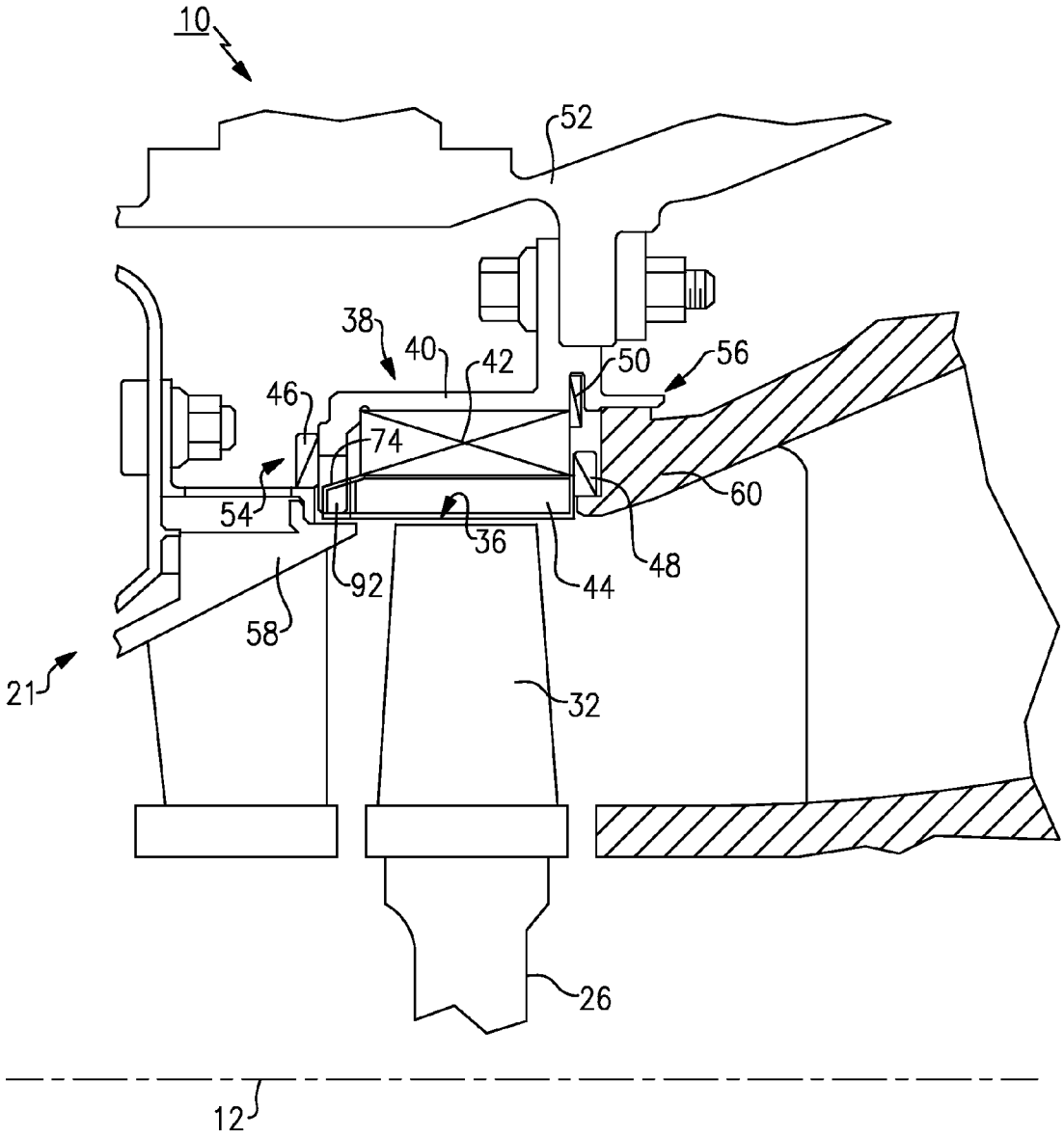
FIG. 2 shows a portion of a gas turbine engine.

FIG. 2 illustrates a portion of the gas turbine engine 10, here a portion of the turbine section 21 of the gas turbine engine 10. However, this disclosure is not limited to the turbine section 21, and could extend to other sections of the gas turbine engine 10.

As shown, a blade 32 has a radial outer portion (tip) 36 closely spaced from a seal assembly 38. In this example, the seal assembly 38 represents a blade outer air seal (BOAS) assembly, although other seal assemblies could benefit from the teachings of this disclosure. The illustrated seal assembly 38 includes a support case 40, a biasing support member 42 and a seal body 44. For simplicity, the biasing support member 42 is generically designated as an "X" in this cross-sectional view but is illustrated in greater detail in FIGS. 3 and 5A, 5B and 5C.

The seal assembly 38 can further include fore and aft seal rings 46, 48 and a retention ring 50. In the illustrated example, the seal assembly 38 is axially bounded on its upstream end 54 via a vane portion 58, and is axially bounded near its downstream end 56 via an aft vane portion 60.

The support case 40 of the seal assembly 38 is attached to an outer casing 52 of the gas turbine engine 10. In the illustrated example, the outer casing 52 is an outer casing of the low pressure turbine section 24 of the gas turbine engine 10, although this disclosure is not limited to the low pressure turbine section. The biasing support member 42 is positioned radially inwardly from the support case 40, and the seal body 44 is positioned radially inwardly from the biasing support member 42, as is further discussed below. Among other attributes, the biasing support member 42 uniformly distributes a compression force about an outer radial surface of the seal body 44 and centers the seal body 44 about the centerline axis 12 of the gas turbine engine 10. In other words, the biasing support member 42 urges the seal body 44 into axial alignment with the centerline axis 12 of the gas turbine engine 10, thereby accommodating differences in thermal expansion between the seal body 44, the support case 40, and the biasing support member 42.

Figure 3:
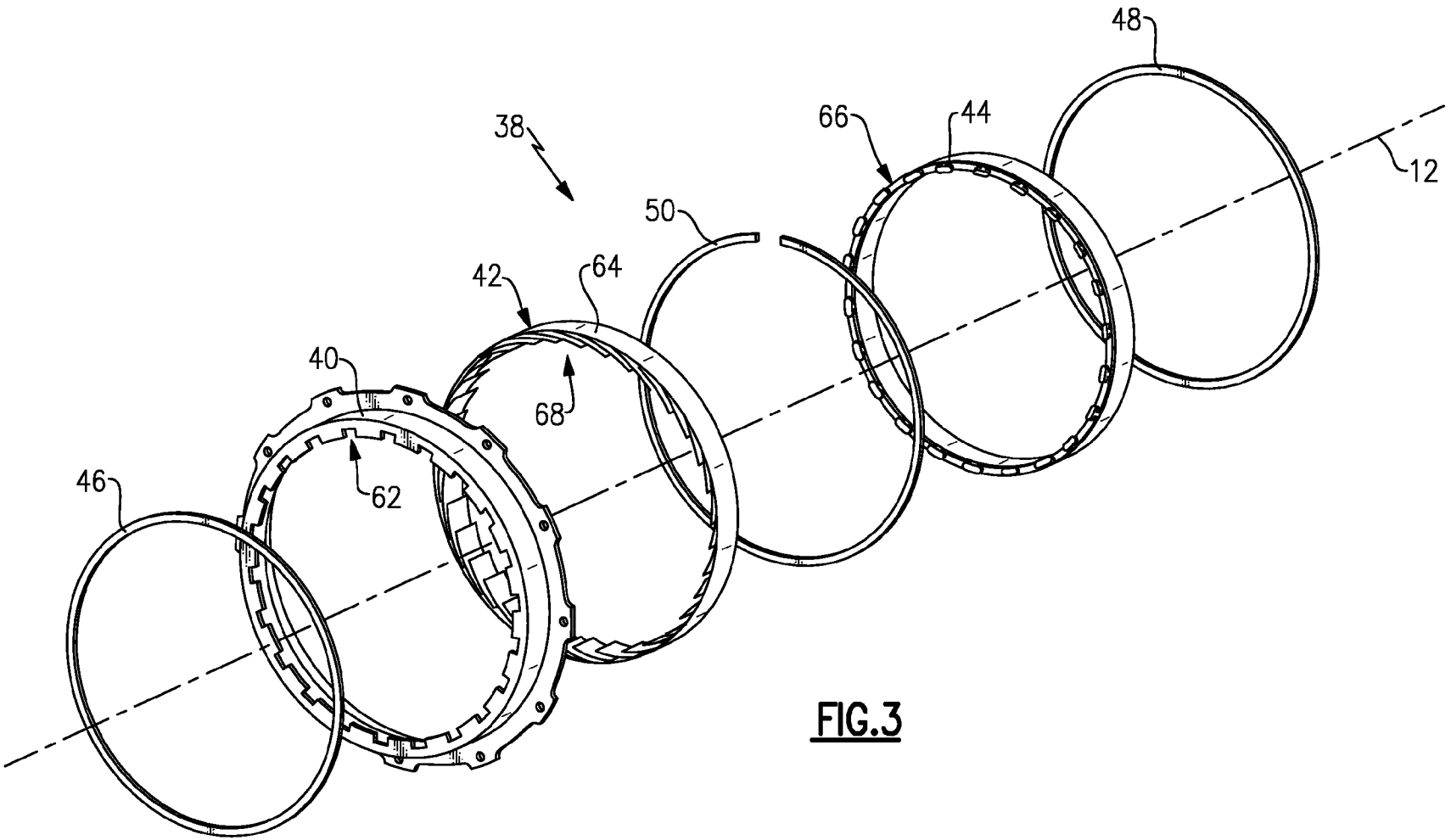
FIG. 3 illustrates an example seal assembly for a gas turbine engine.

FIG. 3 illustrates an exploded view of the seal assembly 38. As can be appreciated, the seal rings 46, 48 are positioned on opposite ends of the seal assembly 38. The support case 40 receives the biasing support member 42 about its inner diameter surface 62. That is, an outer diameter surface 64 of the biasing support member 42 is received against the inner diameter surface 62 of the support case 40. The retention ring 50 maintains the positioning of the biasing support member 42 relative to the support case 40. The biasing support member 42 positions and centers the seal body 44 relative to the gas turbine engine centerline axis 12. In this example, an outer diameter surface 66 of the seal body 44 is positioned radially inwardly from an inner diameter surface 68 of the biasing support member 42. The biasing support member 42 maintains a compression force on the seal body 44 to lower the hoop stresses imparted on the seal body 44.

In this example, the support case 40 and the biasing support member 42 are metallic, while the seal body 44 can include a ceramic material. The ceramic material of the seal body 44 may include a monolithic ceramic or a ceramic matrix composite (CMC) material. The seal rings 46, 48 and the retention ring 50 can include a nickel alloy or any other suitable material. It should be understood that these materials are identified as examples only and that other materials may be suitable to construct the seal assembly 38.

Figure 4A:
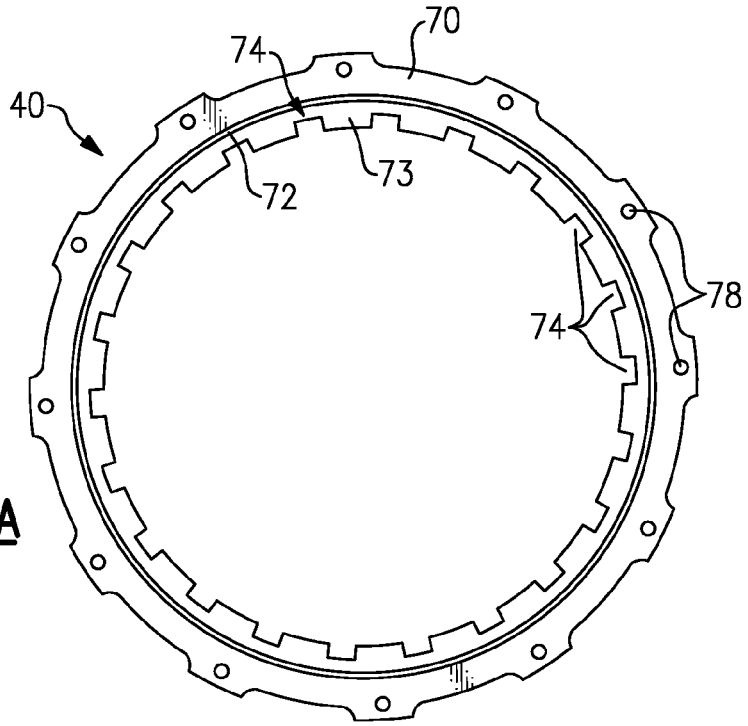
FIGS. 4A, 4B and 4C illustrate a first aspect of a seal assembly for a gas turbine engine.
Figure 4B:
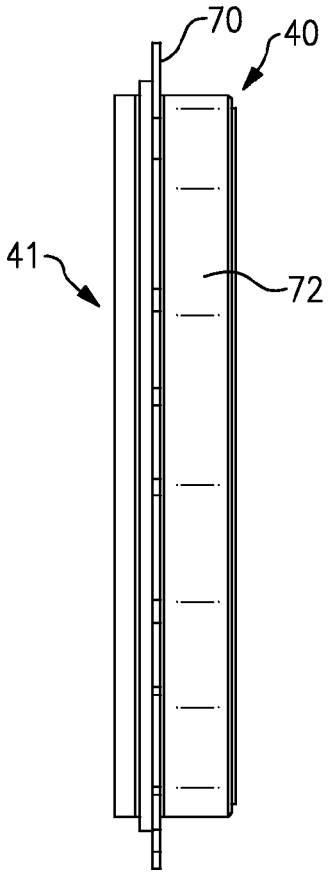
Figure 4C:
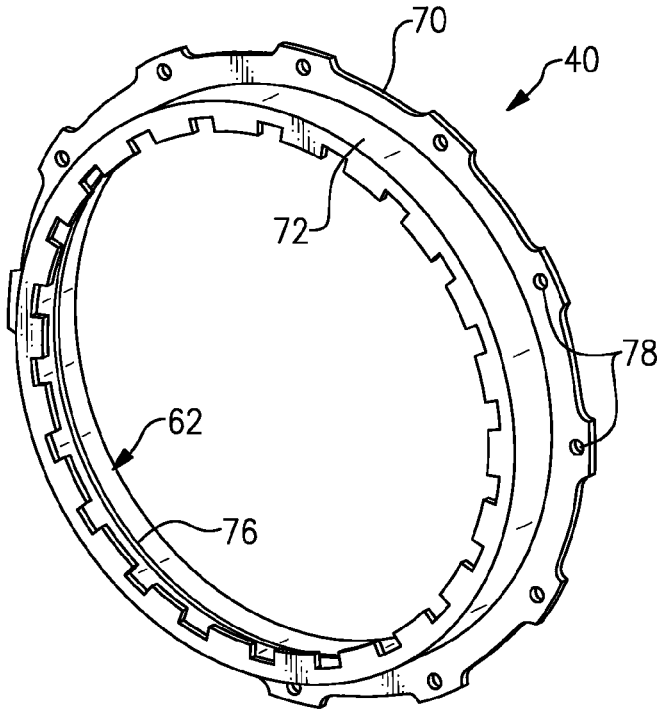

FIGS. 4A, 4B and 4C show the support case 40 of the seal assembly 38. The support case 40 is generally annular in shape and is continuous (i.e., full hoop shaped). The support case 40 includes an attachment flange 70 and a cylinder portion 72. The attachment flange 70 extends radially outwardly from the cylinder portion 72. The attachment flange 70 is operable to mount the support case 40 to the outer casing 52 of the gas turbine engine 10. For example, the attachment flange 70 can include a plurality of openings 78 that receive a fastener, such as a bolt or pin mechanism, to attach the support case 40 to the outer casing 52 (see, e.g., FIG. 2).

The support case 40 includes a face portion 73 that extends radially inwardly from the cylinder portion 72 at an axially upstream side 41 of the support case 40. The face portion 73 includes a plurality of notches 74 that receive a corresponding feature (see, e.g., tabs 92 of FIGS. 6A and 6B) of the seal body 44 to limit any potential clocking of the seal body 44 (See FIG. 2). The corresponding features of the seal body 44 are loosely received by each notch 74 of the support case 40 and can provide anti-rotation features that can reduce the tendency of clocking of the seal body 44 during operation of the gas turbine engine 10. An opposite configuration is also contemplated in which the support case 40 includes tabs and the seal body 44 includes notches that receive the tabs.

As depicted by FIG. 4C, a groove 76 extends circumferentially about the inner diameter surface 62 of the support case 40. The groove 76 receives the retention ring 50 (see FIG. 2). The retention ring 50 positions and retains the biasing support member 42 relative to the support case 40.

Figure 5A:
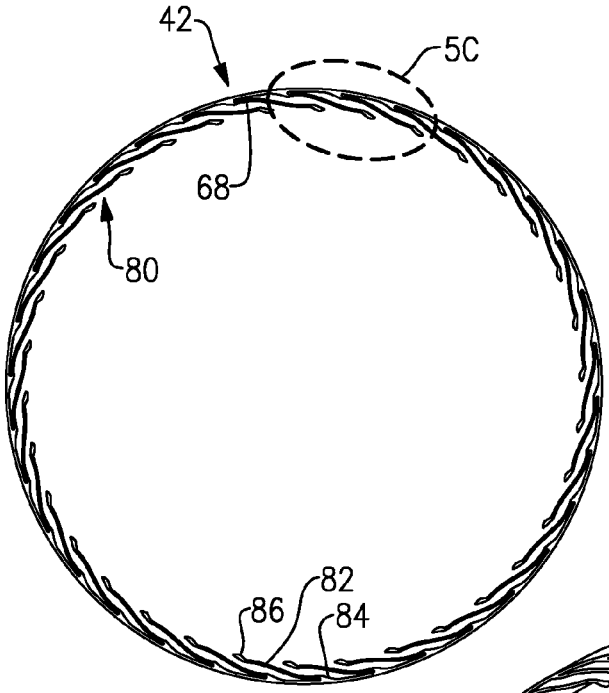
FIGS. 5A, 5B and 5C illustrate a second aspect of a seal assembly for a gas turbine engine.
Figure 5B:
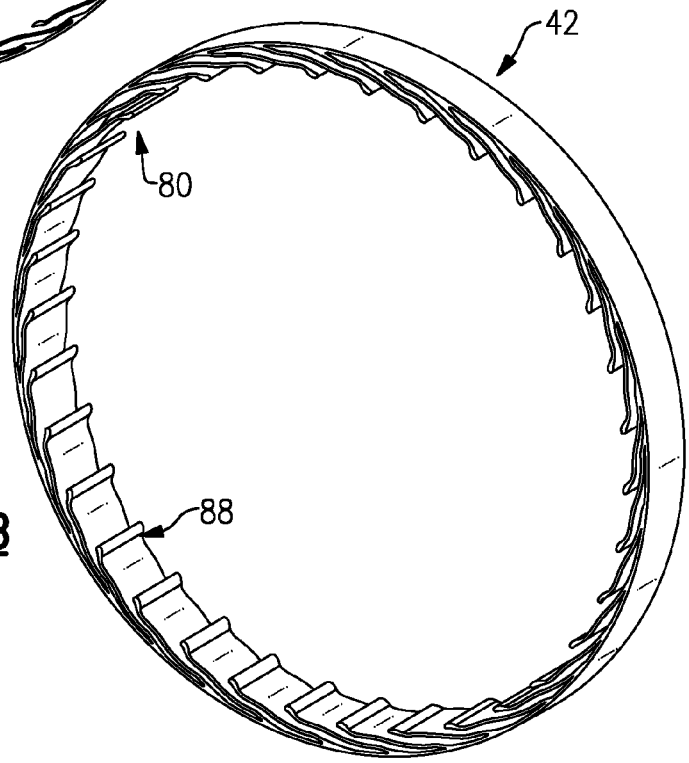
Figure 5C:
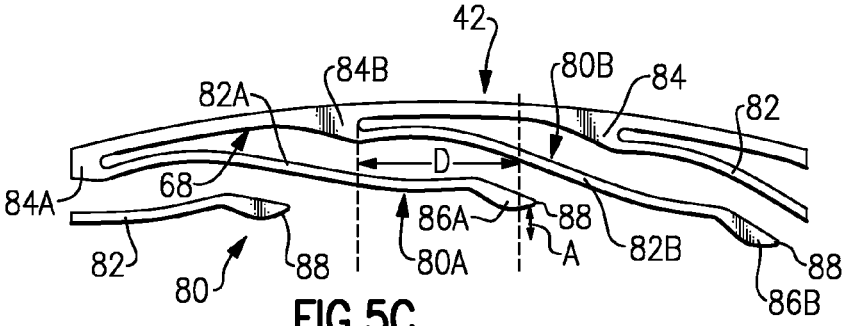

FIGS. 5A, 5B and 5C illustrate the biasing support member 42 of the seal assembly 38. The biasing support member 42 is generally annular shaped and is continuous (i.e., full hoop shaped). The biasing support member 42 includes an array of spring fingers 80 circumferentially disposed about an inner diameter surface 68 of the biasing support member 42. In other words, the spring fingers 80 extend radially inwardly from the inner diameter surface 68 of the biasing support member 42.

Each spring finger 80 is cantilevered and extends from a base portion 84 to a tip portion 86. The array of spring fingers 80 imparts a biasing force to the seal body 44. The tip portions 86 can pivot and deflect in response to radial expansion of a portion of the seal assembly 38. For example, the spring fingers 80 deflect in the direction of arrow A (FIG. 5C) in response to a radial expansion of the seal body 44 (or radial expansion of the support case 40 or outer casing 52) during operation. Deflection of the array of spring fingers 80 dampens vibratory response and decreases the hoop stresses imparted on the seal body 44. The array of spring fingers 80 distribute uniform pressure around the seal body 44 and function to center the seal body 44 relative to the centerline axis 12 of the gas turbine engine 10. The array of spring fingers 80 can also minimize the extent of which material is removed during an eccentric transient rub between the seal body 44 and a blade tip 36 by permitting off-axis or eccentric deflection between the centerlines of the seal body 44 and the gas turbine engine 10.

Each spring finger 80 includes an undulating shaped body 82 that extends between the base portions 84 and the tip portions 86. A thickness of the undulating shaped body 82 is tapered between the base portion 84 and the tip portion 86. The profile of the spring fingers 80 of the biasing support member 42 may be formed using an electrical discharge machining (EDM) technique or other known machining techniques.

The array of spring fingers 80 are circumferentially overlapping. That is, as illustrated by FIG. 5C, when viewed in a clockwise direction, the tip portion 86A of a first spring finger 80A extends to a position that is radially inward and circumferentially offset by a distance D from a base portion 84B of an adjacent spring finger 80B. The tip portion 86A is also radially inward from the undulating shaped body 82B of the spring finger 80B. The tip portions 86A together form a smaller inner diameter than the outer diameter surface 66 of the seal body 44.

The curved shape and overlap of the array of spring fingers 80 permits the spring fingers 80 to be closely packed relative to one another while avoiding contact therebetween. In other words, the undulating shape and overlapped configuration of the array of spring fingers 80 maximizes the number of spring fingers 80 that can be positioned about the circumference of the biasing support member 42. This provides stiffness to the seal assembly 38, limits vibratory modes, dampens vibratory response and maintains proper alignment of the seal body 44 relative to the centerline axis 12 during high loading events.

The outer diameter surface 66 of the seal body 44 is received radially inward of the inner diameter surface 68 of the biasing support member 42. In particular, the outer diameter surface 66 of the seal body 44 is received by the array of spring fingers 80 of the biasing support member 42.

The tip portions 86 of each spring finger 80 include a rounded face 88 that maintain line to line contact and soften the bearing load between the seal body 44 and the spring fingers 80. The spring fingers 80 can further include a coating, such as a cobalt coating, nickel coating or any other suitable coating, that reduces wear on the seal body 44 when received by the biasing support member 42.

Figure 6A:
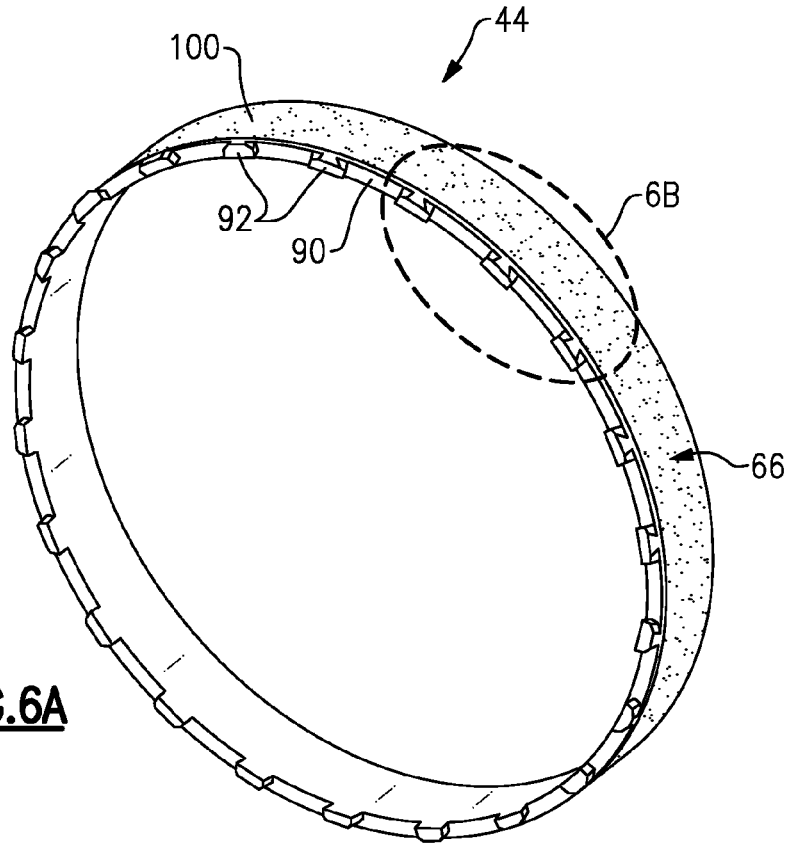
FIGS. 6A and 6B illustrate another aspect of a seal assembly for a gas turbine engine.
Figure 6B:
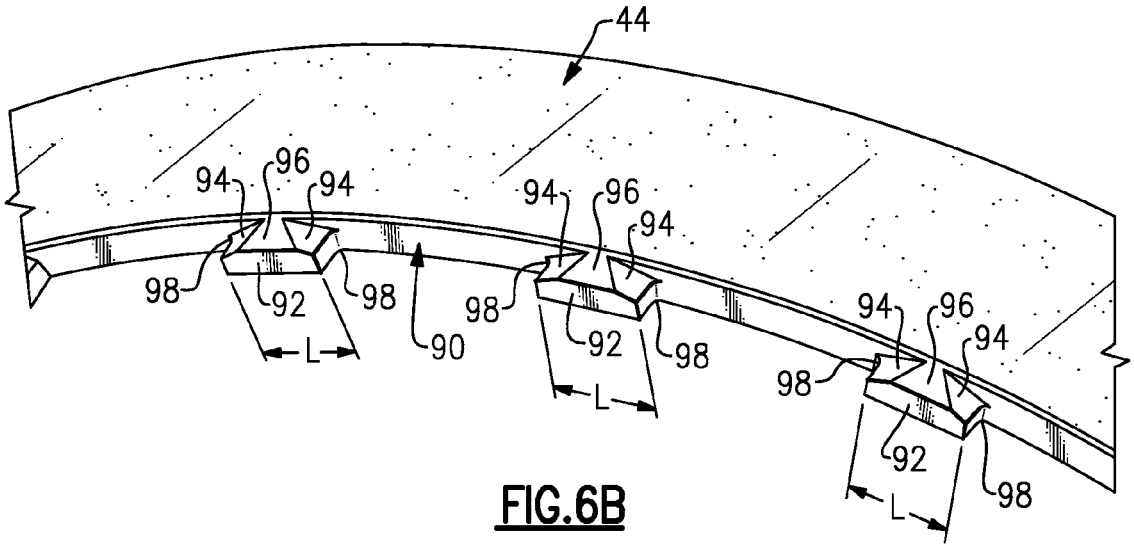

FIGS. 6A and 6B illustrate an example seal body 44 of the seal assembly 38. Similar to the support case 40 and the biasing support member 42, the seal body 44 is generally annular shaped and continuous (i.e., full hoop shaped). The seal body 44 includes an upstream face 90. A plurality of tabs 92 are circumferentially disposed about the upstream face 90 of the seal body 44 and extend generally perpendicular from the upstream face 90. These tabs 92 are received in corresponding notches 74 of the support case 40 to limit rotation of the seal body 44 (see FIGS. 2-4).

In the illustrated example, each tab 92 of the seal body 44 includes chamfered portions 94, 96 that extend in a radially inward direction from the outer diameter surface 66 of the seal body 44 and are circumferentially tapered. The chamfered portions 94, 96 reduce the thickness of each tab 92. The tabs 92 further include a compound fillet 98 and a circumferential length L. The size of the chamfered portions and the compound fillet, and the circumferential spacing of the tabs 92 of the seal body 44, will vary based on design specific parameters, including the size, shape and configuration of the blade that is sealed by the seal assembly 38. The compound chamfering 94, 96 at the outer diameter of the tabs 92 can reduce the circumferential length L of the tabs 92. The combination of the compound chamfering 94, 96 and the circumferential length L reduces the thickness of the tabs 92 in the radial direction and lowers stresses while maintaining strength for anti-rotation capability.

The seal body 44 can also include a barrier coating 100 that provides thermal resistance that protects the seal body 44 from degradation that can occur as a result of the gas turbine engine operating environment. In one example, the entire seal body 44 is coated with the barrier coating 100. The barrier coating 100 minimizes wear on the rounded face 88 of the spring fingers 80 of the biasing support member 42. The barrier coating 100 also provides a rub interface for rub interaction between blade tips 36 and the seal body 44.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A seal assembly for a gas turbine engine, comprising:

a seal body having a generally annular shape that defines an outer diameter surface;

a full hoop biasing support member circumferentially disposed about said outer diameter surface of said seal body, said biasing support member including an array of spring fingers that are circumferentially overlapping about said biasing support member, wherein said array of spring fingers contacts said seal body and centers said seal body relative to a centerline axis of the gas turbine engine;

a support case positioned radially outwardly from said biasing support member;

wherein one of said seal body and said support case includes a plurality of notches and the other of said seal body and said support case includes a plurality of tabs received by said plurality of notches; and wherein each of said plurality of tabs includes chamfered portions that are circumferentially tapered and a compound fillet.

2. The seal assembly as recited in claim 1, wherein said seal body includes a ceramic matrix composite (CMC).

3. The seal assembly as recited in claim 1, wherein said seal body includes a monolithic ceramic material.

4. The seal assembly as recited in claim 1, wherein each spring finger of said array of spring fingers includes a base portion, a tip portion and an undulating shaped body extending between said base portion and said tip portion.

5. The seal assembly as recited in claim 4, wherein a thickness of said undulating shaped body is tapered between said base portion and said tip portion.

6. The seal assembly as recited in claim 4, wherein each spring finger of said array of spring fingers together include a smaller inner diameter as compared to said outer diameter surface of said seal body.

7. The seal assembly as recited in claim 4, wherein each tip portion includes a rounded face.

8. The seal assembly as recited in claim 1, wherein said array of spring fingers includes at least a first spring finger and a second spring finger, wherein a tip portion of said first spring finger is positioned radially inwardly relative to a base portion of said second spring finger.

9. The seal assembly as recited in claim 1, wherein said array of spring fingers are deflectable.

10. The seal assembly as recited in claim 1, comprising fore and aft seal rings positioned on opposite ends of said seal assembly.

11. The seal assembly as recited in claim 1, wherein said support case includes a groove that extends circumferentially about an inner diameter surface of said support case.

12. The seal assembly as recited in claim 11, comprising a retention ring received within said groove.

13. The seal assembly as recited in claim 1, wherein said biasing support member is made of a metallic material.

14. A seal assembly for a gas turbine engine, comprising:

a seal body having a generally annular shape that defines an outer diameter surface;

a biasing support member circumferentially disposed about said outer diameter surface of said seal body, said biasing support member including an array of spring fingers that are circumferentially overlapping about said biasing support member, wherein said array of spring fingers contacts said seal body and centers said seal body relative to a centerline axis of the gas turbine engine; and a support case positioned radially outwardly from said biasing support member, wherein one of said seal body and said support case includes a plurality of notches and the other of said seal body and said support case includes a plurality of tabs received by said plurality of notches, each of said plurality of tabs including chamfered portions that are circumferentially tapered and a compound fillet.

* * * * *